United States Patent [19]

Klein et al.

[11] Patent Number: 5,042,202

[45] Date of Patent: Aug. 27, 1991

[54] BRUSH-HONING MACHINE

[75] Inventors: Gerhard Klein, Oberboihingen; Gerhard Flores, Ostfildern, both of Fed. Rep. of Germany

[73] Assignee: KADIA-Maschinenbau Kopp GmbH & Co., Nurtingen, Fed. Rep. of Germany

[21] Appl. No.: 448,089

[22] Filed: Dec. 13, 1989

[51] Int. Cl.[5] ..... B24B 33/02

[52] U.S. Cl. ..... 51/34 R; 51/34 H; 51/281 P; 51/290

[58] Field of Search ..... 51/34 R, 34 H, 39 E, 51/344, 281 P, 290, 165.93, 165.77, 165.71, 165.87, 103 TF, 58, 112, 111 R, 59 R, 73 R, 165.78

[56] References Cited

U.S. PATENT DOCUMENTS

| | | | |
|---|---|---|---|
| 2,820,328 | 1/1988 | Calvert | 51/34 R |
| 2,820,329 | 1/1958 | Calvert | 51/34 R |
| 2,844,920 | 7/1958 | Calvert | 51/34 R |
| 2,845,752 | 8/1958 | Calvert | 51/34 R |
| 3,286,409 | 11/1966 | Greenberg | 51/34 R |
| 3,324,602 | 6/1967 | Wright | 51/34 R |
| 3,352,067 | 11/1967 | Extabrook | 51/34 H |
| 3,466,809 | 9/1969 | Extabrook | 51/34 R |
| 4,679,357 | 7/1987 | Richter | 51/34 H |
| 4,936,052 | 6/1990 | Nagase | 51/34 E |

*Primary Examiner*—Frederick R. Schmidt
*Assistant Examiner*—Blynn Shideler
*Attorney, Agent, or Firm*—Jones, Tullar & Cooper

[57] ABSTRACT

A brush-honing machine including a brush-honing tool which is displaceable both axially and rotationally thereby displacing a plurality of brush elements of the tool both axially and radially. A step motor is provided the angular movement of which is translated into the noted axial and radial displacement.

3 Claims, 3 Drawing Sheets

BRUSH-HONING MACHINE

BACKGROUND OF THE INVENTION

1. Field of the Invention

The invention relates to a control mechanism in a brush-honing machine to compensate for the wear of the brushes.

2. Prior Art

Brush-honing is a process to improve honed surfaces of borings or the like as described, for example, in European patent application EP-A1-0 247 572 (published Dec. 2, 1987). Actually, after honing, the honed surfaces are further treated with brushes under certain conditions to improve the quality of the surfaces by reducing burrs and grate-like sheet metal particles, which are generated and not removed in the preceding honing process.

Further, such brush-honing treatment may be used to provide the end treatment of borings in workpieces of certain aluminum alloys, especially silica containing aluminum alloys like $AlSi_{17}Cu_4MG$, in which relatively hard silicon crystals are embedded in a considerably softer aluminum matrix. If a boring in a workpiece of such a material, e.g. in a cylinder block for a combustion engine, is treated by brush-honing, the soft aluminum matrix will be somewhat moved around the harder silicon crystals, which will remain unaffected by this operation, such that thereafter the harder crystals project a little over the surface of the aluminum matrix . The projecting crystals will serve as bearing surfaces for any corresponding and/or cooperating other metal part, e.g. for the piston in an engine block. At the same time, the softer portions, of which some material has been removed, will serve as pockets for lubricating liquids. This treatment is applied especially to high-quality aluminum cylinder blocks for automobile engines, which, before such brush-honing method had been developed, were treated by a complicated etching process.

In connection with such a brush-honing operation, the brushes basically are applied in the same manner as honing tools are applied in the honing process, i.e. they are introduced into the boring and, while the free ends of the brushes or bristles respectively are pressed with some predetermined tension radially against the interior wall of the boring, they are rotated and at the same time moved upwardly and downwardly in the axial direction of the boring. The brushing then essentially follows the cross pattern, which has been produced in the honing process. Rotation may also be reversed when used in connection with the mentioned treatment of boring silicon containing alloys.

In order to maintain a certain predetermined tension of the free ends of the bristles of the brushes against the interior wall of the boring despite their wear, the tools, which carry the brush elements, can expand in the radial direction. The tension of the brush or bristles is usually measured by the amount with which the outer diameter of the brush is larger than the diameter of the boring of the workpiece. However, the counter pressure exerted by the wall of the boring on the bristles of the brush and on the tool is not strong enough to keep the brush at a position in which the tension of the brush or the bristles is exactly determined.

In other words, the adaption of conventional honing-machines for such brush-honing as are described in European patent application EP-A1-0 247 572, is rather difficult, since brush-honing can not rely on an exact position of a surface-to-surface-contact of the tool against the workpiece to define a predetermined tension of the brush or bristles respectively against the surface of the workpiece. Further, the rotational speed of the tool (up to 400 rpm) is much higher than with conventional honing, while the pressure of the tool against the workpiece surface is much less.

SUMMARY OF THE INVENTION

It is an object of the present invention to overcome this difficulty and to provide a control mechanism for a brush-honing tool, which can be adjusted in such a manner that a predetermined tension of the brush or the bristles can exactly be provided and corrected to compensate for any wear of the brushes.

A new control mechanism is proposed which effects the necessary reciprocal and radial movement of the brush-honing tool such that the noted predetermined tension is achieved.

The desired movement is achieved by the new control mechanism disclosed below by reference to the accompanying drawings.

DESCRIPTION OF THE PREFERRED EMBODIMENT

Figure 1:
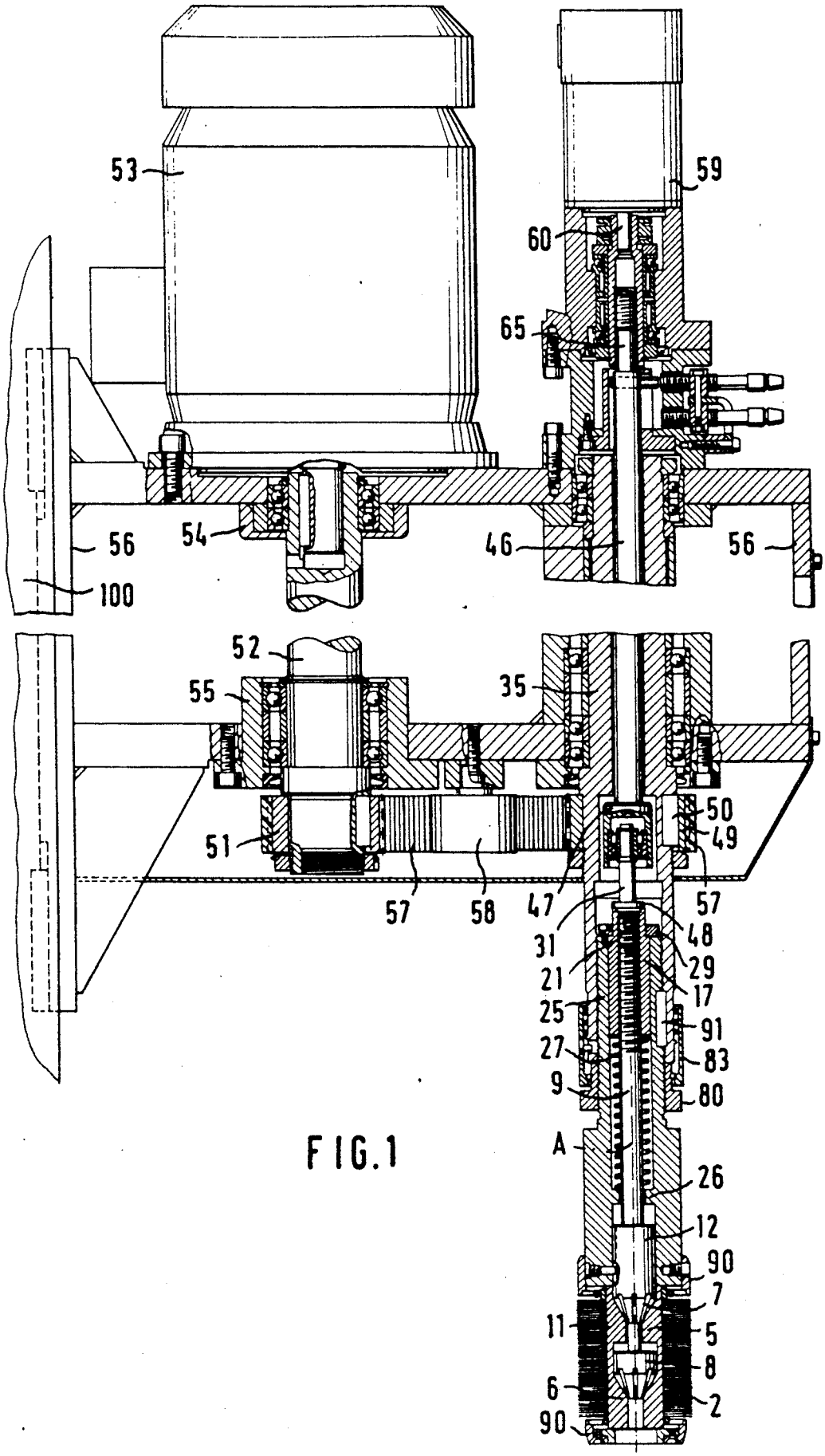
FIG. 1 is an elevational view, partly in cross section, of a preferred embodiment of the invention.
Figure 2:
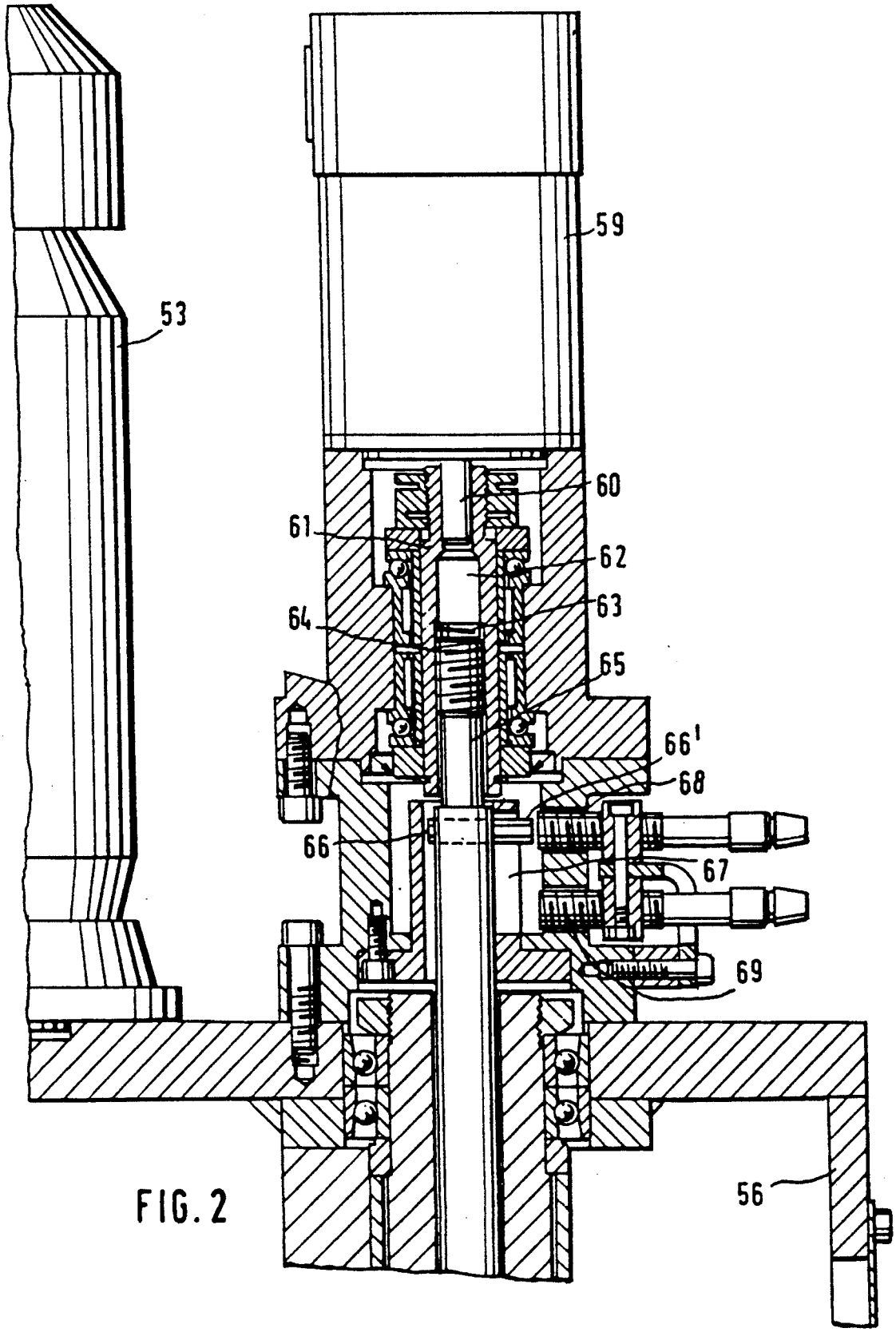
FIG. 2 illustrates the upper portion of the embodiment of FIG. 1 on an enlarged scale.
Figure 3:
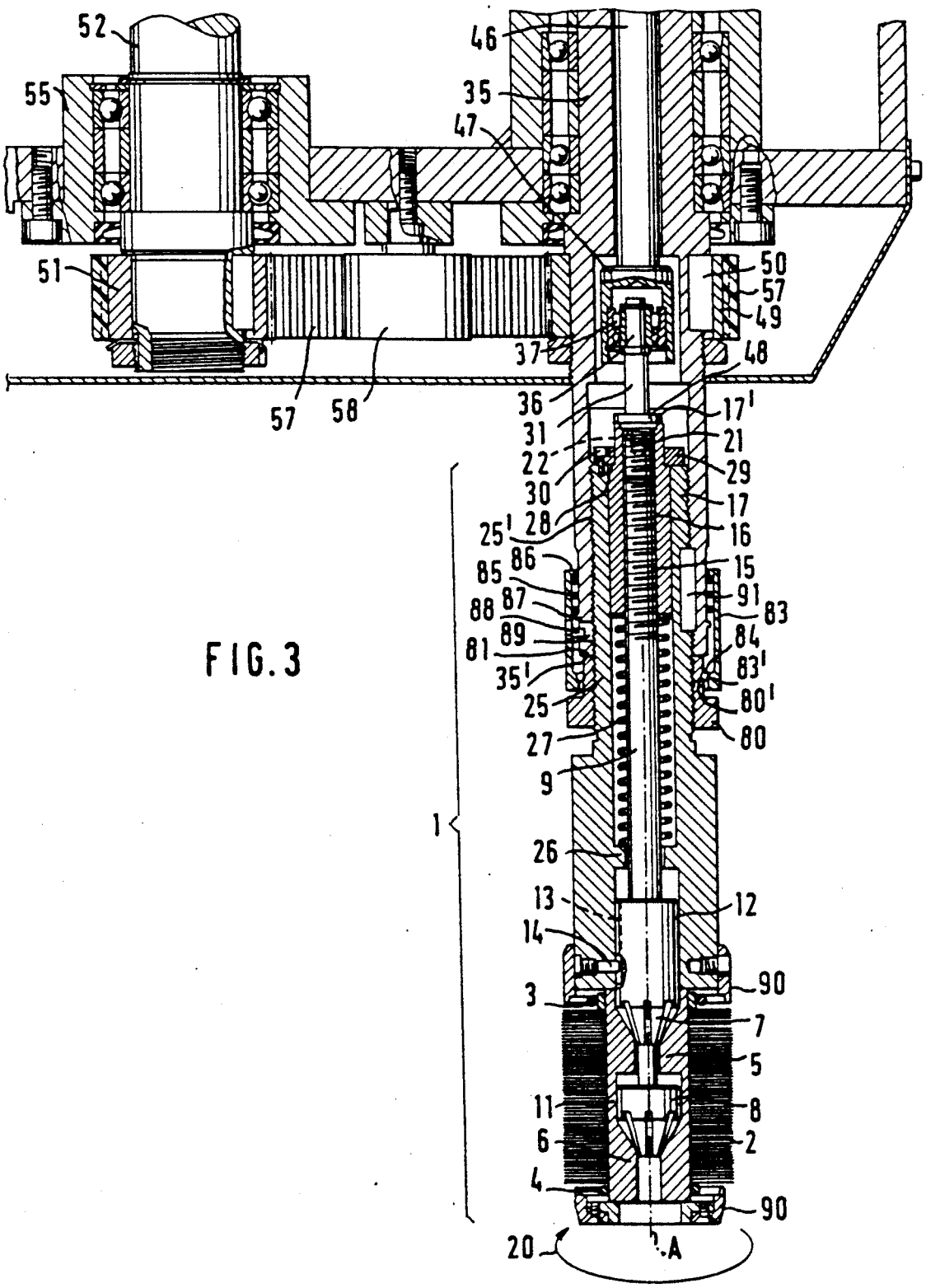
FIG. 3 illustrates the lower portion of the embodiment of FIG. 1 on an enlarged scale.

In the drawings, the tool 1, which basically is the same as that shown in EP-A1-0 247 572, comprises a number of brush elements 2, which are circumferentially distributed around the tool axis A. The brush elements 2 radially extend through slots in a cage-like holding member 90, which is connected to the tool body 25. The brush elements 2 comprise bristles, which have one of their ends fastened to metal strips 11. These strips are held together by springs 3, 4 (FIG. 3). Cam surfaces 5, 6 of the brush elements 2 are pressed against respective conical expanding members 7, 8, which form the forward end of a tool control bar 9 which extends in the axial direction of the tool 1. When the tool control bar 9 is moved downward in the axial direction, the brush elements 2 will be forced radially outwardly. If the control bar 9 moves in the upward direction, the brush elements 2 can move radially inwardly under the force of springs 3, 4. Also part of the tool control bar 9 is a cylindrical portion 12, which is provided with a groove 13 (FIG. 3), into which a bolt 14 extends for preventing the tool control bar 9 from rotation with respect to the tool body 25.

At its upper end, the tool control bar 9 is provided with an outer thread 15, which is received within an interior thread 16 of a hollow sleeve member 17. Once the hollow sleeve member 17 has a defined position in the axial direction, the extent, to which the tool control bar 9 is threaded into the sleeve member 17, will define a particular position of the conical extending members 7, 8 and thereby also of cam surfaces 5, 6. Thus, the exact length, to which the tool control bar 9 is threaded into the hollow sleeve member 17, defines the expansion state of the brush element 2 in the radial direction.

This particular position of the tool control bar 9 within the hollow sleeve member 17 is fixed by a screw 21 screwed into the interior thread 16 from above by inserting an appropriate tool into its socket 22. This socket 22 can be reached through the open upper end of sleeve member 17.

The sleeve member 17 is movably received within the tool body 25. Tool body 25 also basically has the form of a hollow sleeve. It is provided with an internal rim 26. Between this rim 26 and the tool body 25 there is provided an expansion spring 27, which presses the sleeve member 17 with its shoulder 28 against an abutment disc 29, which is secured by screws 30 to the tool body 25.

The unit comprising the tool control bar 9 and the sleeve member 17, can be pushed in the downward direction within the tool body 25 and relative to it against the force of spring 27 by a plunger rod 31, which rests against the upper front surface 17' of the sleeve 17. Such downward movement will expand the brush elements 2 in the radial direction, provided that the tool body 25 is axially held in place during this operation as explained below.

The means for rotating the tool comprises a spindle 35, which is rotated, as will be described later, by a motor 53. The spindle 35 receives the tool member 25 as follows: the tool member 25 has an outer trapezoidal thread 25', on which a sleeve 80 is positioned, which is provided with corresponding internal ' thread. On the other hand, the external thread 25' on the tool member 25 does not engage the internal surface of the spindle 35. The tool member 25 in this respect is able to be inserted freely in the interior boring of the spindle 35, while rotation therein is prevented by a leaf spring 91. The sleeve 80 will be brought manually by rotation in such a position that its upper face 81 abuts the lower face 35' of the spindle 35 in a position, in which the upper front surface 17' of sleeve 17 rests against the enlarged portion 48 of the plunger rod 31. This situation then is fixed by a clamping member 83. In the position shown, the inclined surface '83 of the clamping member 83 presses against a number of circumferentially distributed balls 84. These balls 84 are held in a cage (not shown for simplicity reasons) and together form a bearing; they rest in a corresponding groove 80' in the outer side of the sleeve 80. Thus, the sleeve 80 is locked to the clamping member 83. At the same time, the clamping member 83 is pressed upwardly by a spring 85, which with its one end abuts the rim 86 of the clamping member 83 and with its other end abuts flange 87 of spindle 35. The motion of the clamping member 83 in the axial direction is limited by a bolt 88, which is connected to the clamping member 83 and extends into a slot 89 in the spindle 35. By manually moving the clamping member 83 downward and thereby compressing the spring 85, the inclined surface 83' will move out of contact with balls 84 and thus allow them to expand radially outwardly out of the groove 80' and thereby release the sleeve 80 such that it can be pulled out of its engagement with the clamping member 83.

When the parts are in the position, as explained so far, then any downward movement of the plunger rod 31 will also move the sleeve 17 downwardly within the tool body 25, which is held in space to rest at the spindle 35 by the clamping member 83. This downward motion of sleeve 17 will expand the brush elements 2 as explained.

The plunger rod 31 is connected to a further plunger rod 46. The connection is made such that any downward motion of the rod 46 also will push the rod 31 in the downward direction. However, while the rod 46 does not rotate and only moves in the axial direction, the rod 31 can rotate with the tool 1, when it is with its enlarged portion 48, in contact with the upper face 17' of sleeve 17, which latter rotates with spindle 35.

For this purpose, the rod 46 is integrally provided with a bell-shaped coupling member 47, which extends around an enlarged portion 36 of rod 31. A combined needle and roller bearing 37 is provided such that rod 31 can rotate, while rod 46 can not and a downward pressure can be transmitted from rod 46 to rod 31.

To rotate the spindle 35, the spindle 35 carries a sprocket wheel 49. The connection between the spindle 35 and the sprocket wheel 49 is effected by a leaf spring 50 received in a groove of the spindle 35 and in a corresponding groove in the sprocket wheel 49. A similar sprocket wheel 51 is provided at the free end of a shaft 52, which is driven by the motor 53 and held by bearings 54, 55 within an arm structure generally indicated by 56. A belt 57 transmits the rotation from the shaft 52 to the spindle 35. The belt 57 also runs over an adjustable belt tensioning wheel 58. The machine arm structure 56 is moveable in the upward and downward direction along a machine support guiding element 100 by appropriate driving means. This is done in the usual manner as known from normal honing machines and thus needs not be described in greater detail.

The displacement of the plunger rod 46 is effected by a step motor 59. The end of driving shaft 60 of the step motor 59 is fixed by a press-fit to a driving sleeve 61, within which a boring 62 is provided. Boring 62 is internally provided with a thread 63. This boring 62 of sleeve 61 receives a threaded head 64 integrally connected to a shaft 65 and to plunger rod 46. At the same time a bolt 66 is provided close to the upper end of plunger rod 46 and extends therefrom to its right side. The projecting end 66' of bolt 66 is received within a longitudinal groove 67 connected to the machine arm structure 56 such that this bolt/groove-arrangement prevents the plunger rod 46 and head 64 from rotation. Thus, when the driving sleeve 61 is rotated by the step motor 59, this will result in a downward axial movement of rod 46. With this axial motion, the projecting end 66' of bolt 66 also moves in the axial direction. Its end positions will be detected by position sensing elements 68, 69. These might be of the magnetic type and suited to derive an appropriate electrical signal whenever the projecting end 66' is positioned exactly.

The operation of the machine is as follows:

When the tool 1 including tool body 25 is not yet positioned within the machine as shown, the tool control bar 9, with its threaded portion 15, will be screwed so far into sleeve 17 and fixed in this position by screw 21, that the ends of the bristles constituting brush elements 2 will define a predetermined outer brush diameter to be used in the brush-honing process. The tool body 25 then will be introduced into the spindle 35 until the end of sleeve 17 abuts the enlarged portion 48. This insertion is done while clamping member 83 is in the downward position. When it is released, it then will move upwardly and lock tool body 25 within spindle 35. When the motor 53 is energized, the spindle 35 together with tool 1 will rotate. While motor 53 rotates spindle 35, the frame arm structure 56 will be moved in the upward and downward direction between end points, which define the stroke of the brush honing operation and are determined by the size and position of the boring to be brush-honed. At certain intervals, which are determined from experience, to compensate the wear of the brushes and the corresponding decrease of tension of them against the surfaces of the workpieces, will be compensated by a certain angular motion of the step motor 59 resulting in a certain axial displacement of rods 46 and 31, which then by also displacing sleeve 17 within tool body 25 will effect a certain radial expansion of the brush elements 2.

What we claim is:

1. A brush-honing machine, comprising:

guide means, an arm structure mounted to be axially displaceable relative to said guide means, a spindle defining an axis of rotation, and a motor for driving said spindle, said spindle and said motor mounted to said arm structure.

a step motor mounted to said arm structure and a threaded shaft connected to said step motor and given a predetermined angular movement by said step motor;

a first rod mounted to said arm structure, said first rod having a threaded portion engageable with said threaded shaft such that a predetermined angular movement of said threaded shaft is imparted to said first rod to displace said first rod in the direction of said axis of rotation;

a brush-honing tool including a tool body received within said spindle, control bar means axially displaceable within said tool body in the direction of said axis of rotation, and a plurality of brush elements radially displaceable with respect to said axis of rotation in response to axial movement of said control bar means; and a second rod abutting said control bar means and coupled to said first rod by a combined roller and needle bearing, such that a force in the axial direction of said axis of rotation to be transmitted from said first rod to said second rod displacing the second rod in said axial direction in response to an axial displacement of said first rod and allowing the second rod to rotate relative to said first rod, such that an angular movement of said step motor effects a predetermined radial displacement of said brush elements.

2. The brush-honing machine as defined in claim 1, wherein the brush-honing tool further include stop means in said tool body, a sleeve in which the control bar means is fixedly and adjustably received, a spring for pressing said sleeve against said stop means, and a further spring and biased clamping means for clamping said tool body to abut said spindle.

3. The brush-honing machine as defined in claim 2, further comprising a screw, and wherein said spindle includes a threaded portion, and said control bar means includes a threaded portion in engagement with the threaded portion of said spindle for adjustment of said control bar means to an adjusted position, the adjusted position of said control bar means being fixed by said screw.

* * * * *